F-419 SP
10/15/85 OR 4,546,507

United States Patent [19]
Weinstein

[11] Patent Number: 4,546,507
[45] Date of Patent: Oct. 15, 1985

[54] BEACH KIT INCLUDING CONVERTIBLE BAG-PILLOW COVER

[76] Inventor: Eric Weinstein, 3884 Butler Rd., Blynelon, Md. 21011

[21] Appl. No.: 634,055

[22] Filed: Jul. 25, 1984

[51] Int. Cl.[4] ..... A45C 3/10; A47G 9/06
[52] U.S. Cl. ..... 5/419; 5/417; 190/2
[58] Field of Search ..... 5/417, 418, 419, 420, 5/482; 190/1, 2, 8; 383/4

[56] References Cited

U.S. PATENT DOCUMENTS 1,222,563 4/1917 Rosenberg ..... 5/419
2,190,566 2/1940 Julian ..... 5/418
2,675,807 4/1954 Pursel ..... 5/417
2,898,609 8/1959 Storie ..... 5/419
4,154,323 5/1979 Sneider ..... 190/2

*Primary Examiner*—Gary L. Smith
*Assistant Examiner*—Vinh Luong
*Attorney, Agent, or Firm*—Larson and Taylor

[57] ABSTRACT

A beach kit is provided which includes a beach towel, an inflatable pillow, a pillow cover in which the pillow is received, and stakes for staking the pillow cover and towel together to the sand. The cover is convertible into a carrying bag or case and includes reinforcing members (e.g. pairs of wooden dowels) located along two edges, and fasteners at the corners for connecting the ends together to form the bag. The stakes fit through aligned openings in the cover and towel to hold the two together.

1 Claim, 5 Drawing Figures

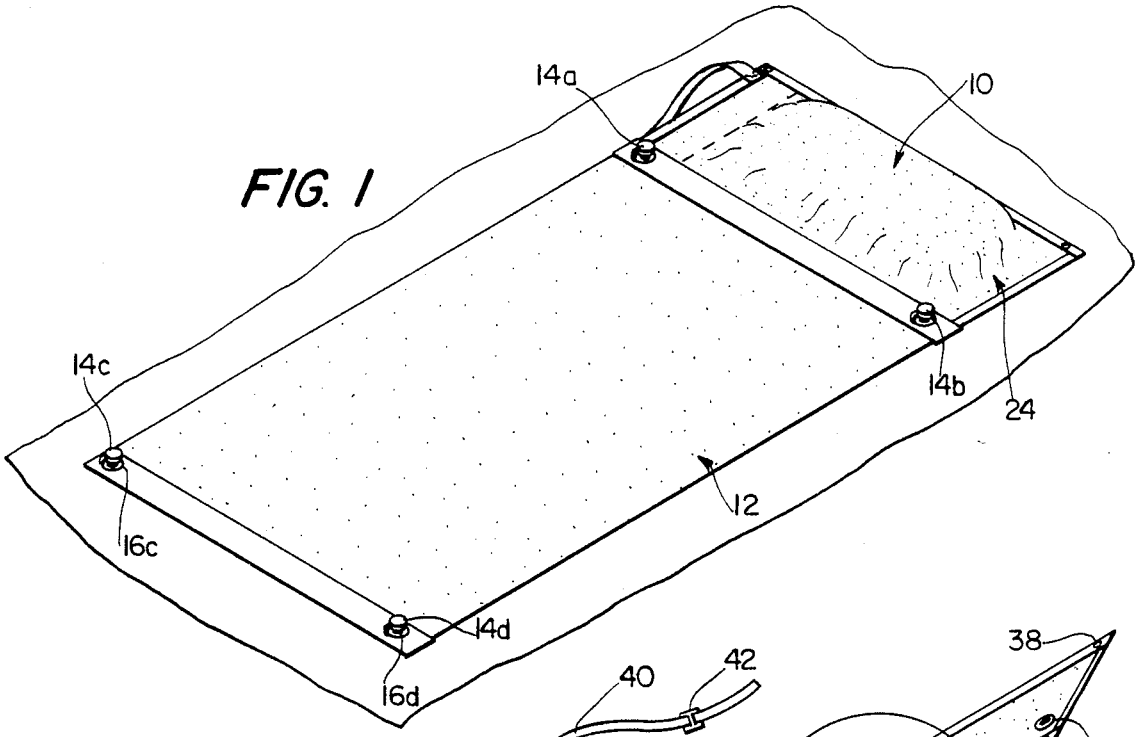
FIG. 1
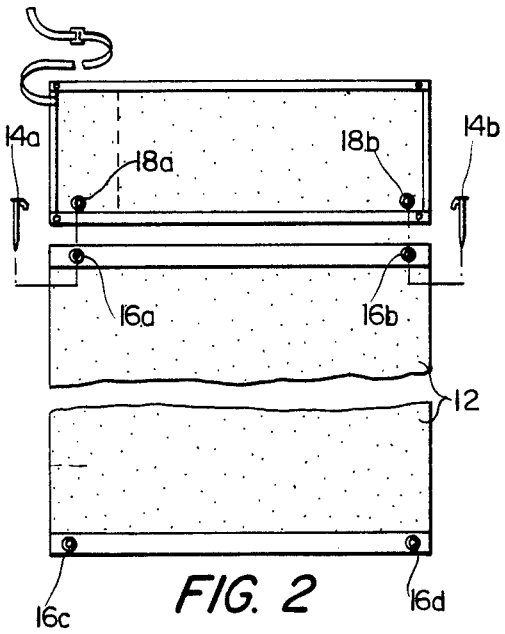
FIG. 2
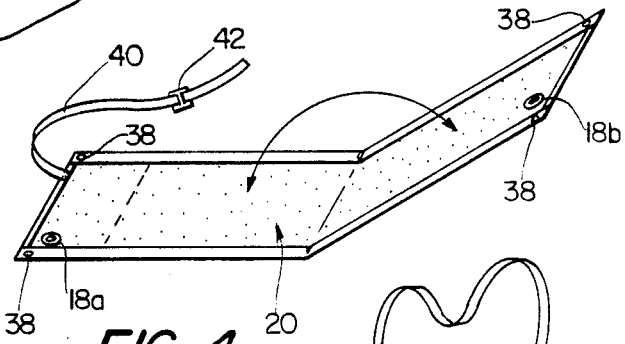
FIG. 4
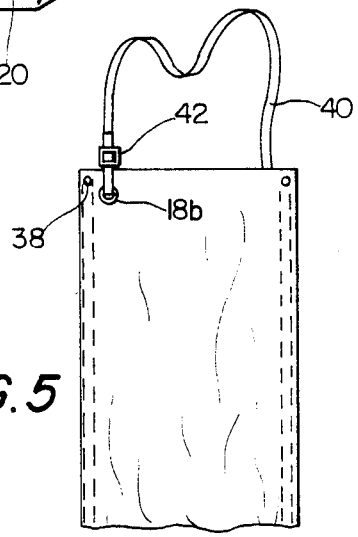
FIG. 5
FIG. 3
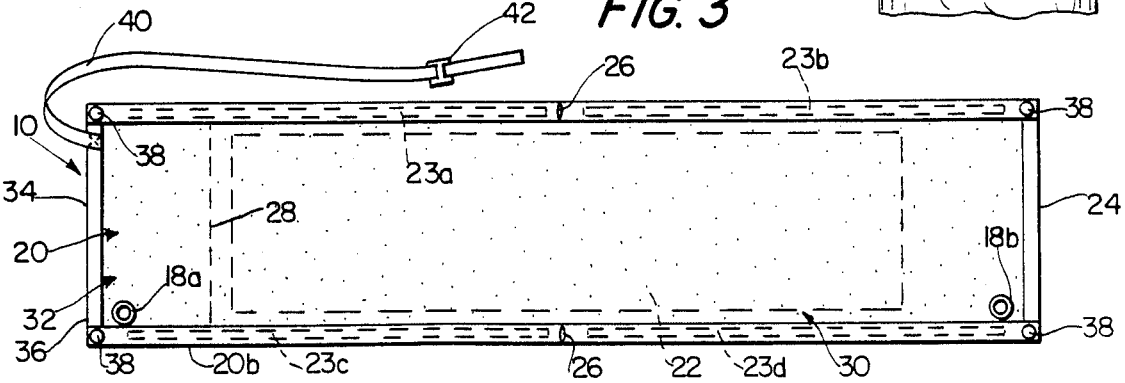

BEACH KIT INCLUDING CONVERTIBLE BAG-PILLOW COVER

FIELD OF INVENTION

The present invention relates to a beach kit or assembly including a beach blanket (towel) and a pillow which converts into a carrying bag for the blanket.

BACKGROUND OF THE INVENTION

A number of patents have been granted for combination beach mats or towels and pillows wherein the components of the combination fold up into a carrying bag or into a compact unit for carrying. Examples of such patents include U.S. Pat. Nos. 4,375,111 (Hall); 2,451,142 (Zimmern); 2,659,404 (Kelsey); 2,626,648 (Anderson); 3,976,113 (Kim); and 3,052,895 (LoVico). The Hall patent describes a convertible beach mat which is lightweight and folds into a carrying bag. The mat includes a head portion which can be inflated to form a pillow, and a pocket for carrying smaller items. The Zimmern patent discloses a carrying bag, made of water proofed cloth, which converts into a blanket with an inflatable pillow. The bag also has an inner compartment for smaller articles. The Kelsey patent discloses a combination beach towel and bag, the towel being made of an elongated rectangular sheet of terry cloth, and the bag including inner pockets. The Anderson patent discloses a combination towel and beach bag with waterproof lining covering the toweling material. The Kim patent discloses a convertible blanket of rectangular shape which is folded to form a tote bag. Closure can be carried out using Velcro fasteners. The LoVico patent discloses a beach bag which can be opened into a blanket, and which contains inside pockets for maintaining articles in a dry condition.

Although the beach bag-towel combinations disclosed in these patents are useful and provide certain obvious advantages over ordinary beach towels and beach bags alone, they do not provide the particular advantages of the present invention discussed below.

SUMMARY OF THE INVENTION

In accordance with the present invention, a beach "kit" or assembly is provided which affords a number of advantages over similar devices of the prior art, including the beach towel-beach bag combinations discussed above.

In accordance with a preferred embodiment, the beach kit comprises: a pillow; a beach towel or blanket having openings therein at opposite edges thereof; and a cover for the pillow including an open end through which the pillow can be inserted. The cover includes stiffening means incorporated therein along two edges thereof and fastener means located at the corners thereof for enabling opposite edges of the cover to be fastened together to form a carrying case, with the stiffening means being disposed along the lateral edges of the carrying case to form a carrying space. The pillow cover further includes openings therein arranged to be aligned with the openings at one end of the beach towel, and a plurality of stakes are provided which are adapted to be inserted through the aligned openings in the cover and beach towel, and through the openings at the opposite edge of the beach towel, for affixing the beach towel and the cover in place in the sand while connecting the cover to the beach towel. The carrying case is used to carry the other components of the kit and thus, the carrying case, while a separate component of the kit, is an integral part of the assembled kit, serving, in cooperation with the stakes, to hold down the towel in addition to functioning as a pillow cover.

The pillow is preferably inflatable and is adapted, when deflated, to be received in the carrying case formed by the pillow cover. The cover preferably includes a hidden or "secret" compartment formed at the other thereof from the pillow receiving end, including an interlocking strip-like fastener or closure, or the like, for the open end of the compartment. In this regard, the pillow cover advantageously comprises a flat tubular cloth member (e.g., fabricated, of terrycloth) including transverse stitching joining the opposite sides thereof so as to form a first, relatively large compartment in which the pillow is received and the second, relatively small "secret" compartment for receiving (and hiding) small items such as valuables.

Preferably, the pillow cover also includes a first and second elongate compartments formed respectively along two opposite edges thereof, and the reinforcing means comprise a first pair of dowels or the like received in the first compartment and a second pair of dowels of the like received in the second compartment. These compartments each include a central opening through which the dowels can be removed so as to permit machine washing of the cover.

Advantageously, the cover also includes a carrying strap which is sewed to one edge thereof and which preferably includes an adjustable buckle.

Other features and advantages of the present invention will be set forth in, or apparent from, the detailed description of a preferred embodiment which follows.

BRIEF DESCRIPTION OF THE DRAWINGS

FIG. 1 is a diagrammatic perspective view of the beach kit of the invention, as assembled and in use;

FIG. 2 is a plan view of the beach pillow and beach towel of the invention, showing the manner in which the two are interconnected in use;

FIG. 3 is a plan view of the pillow cover of the invention;

FIG. 4 is a diagrammatic perspective view showing the manner in which the pillow cover folds into a carrying case; and FIG. 5 is a side elevational view of the carrying case formed by the pillow cover.

DESCRIPTION OF A PREFERRED EMBODIMENT

Referring to FIG. 1, the beach kit of the invention is shown in use. Two basic components of the kit are a pillow forming portion, denoted 10, and a beach towel or blanket 12. As was discussed above, and is explained in more detail below, the pillow forming portion 10 basically comprises a separate inflatable pillow, and a pillow case or cover which converts into a carrying bag, and the two together will generally be referred to as a beach pillow for shorthand purposes. A set of four stakes, generally denoted 14, are used to affix the beach pillow 10 and blanket 12 to the sand so that the wind does not blow them away. The lowermost stakes **14*c* and 14*d* extend through grommets 16*c* and 16*d* provided for openings in the bottom edge of blanket 12 (see also FIG. 2) while the upper stakes 14*a* and 14*b* extend through grommets 16*a* and 16*b* in the upper edge of blanket 12 (see also FIG. 2) as well as through an aligned pair of grommets 18***a* and 18*b* formed in beach pillow 10. As shown in FIG. 2, the beach pillow 10 and the blanket or towel 12 are separate components of the kit and as described above, are joined together in edge to edge relationship by stakes 14*a* and 14*b*.

Referring to FIG. 3, an enlarged view is shown of the beach pillow 10. As mentioned above, the beach pillow 10 basically comprises a pillow cover or casing, denoted 20, and an inflatable pillow, denoted 22, which is received in an opening at one end 24 of cover 20. The upper and lower edges of cover 20 are overlapped and sewn to form elongate compartments 20*a* and 20*b* in which pairs of a set of four dowels 23*a*, 23*b*, 23*c* and 23*d* are respectively received, as illustrated. To this end, "button holes" or like openings, denoted 26, are provided centrally of the two compartments 20*a* and 20*b* through which the dowels can be inserted so that they take the positions shown in FIG. 3.

Additional stitching is provided as indicated at 28 to join the opposite sides of cover 20 together and thereby divide the cover into a relatively large compartment 30 for inflatable pillow 22 and a relatively small, secret or hidden compartment 32 for loose terms such as change, cameras and other valuables. Cooperating interlocking strip-type fasteners, indicated at 34, are provided at the other edge 36 of cover 20 to enable the secret compartment 32 to be closed.

Snap fasteners 39 are provided at the four corners of cover 20 and enable the opposite edges 24 and 36 of cover 20 to be snapped together, as illustrated in FIG. 4, to form a carrying case.

A carrying strap 40 is sewn to edge 24 and includes an adjustable plastic buckle 42 as illustrated in FIG. 5, the strap 40 is looped through an opening formed by the aligned grommets 18*a* and 18*b* and inserted through the adjustable buckle 42. Thus, with the opposing fasteners 39 secured together, dowels 23*a*, 23*b*, 23*c* and 24*d* cooperate to form the lateral sides of the carrying case or bag and the case so formed provides a carrying space for the other components of the kit, e.g., the pillow 22, the stakes 14 and the beach towel or blanket 12.

In a specific exemplary non-limiting embodiment, one side of the cover 20 is made of terrycloth while the reverse side is made of a cotton polyester band. The dowels 23*a*, 23*b*, 23*c* and 23*d* are made of 5/16 inch diameter wood and the bindings are cotton-polyester. The towel 12 is terry velour and measures 76 by 45 inches (not including the pillow). The pillow cover 20 measures 15 by 45 inches in the open portion and 15 by 22.5 inches in the closed position wherein the carrying case is formed. The hidden compartment 32 measures 13 by 7 inches, the stakes are 6 inches by ½ inch and made of plastic and the grommets are ⅝ inch brass grommets.

Although the invention has been described relative to an exemplary embodiment thereof, it will be understood by those skilled in the art that variations and modifications can be effected in this exemplary embodiment without departing from the scope and spirit of the invention.

I claim:

1. A beach kit comprising:

an inflatable pillow;

an elongate beach towel having at least two grommeted openings in each of two opposite edges thereof;

a generally rectangularly shaped cover for said pillow divided by transverse stitching into a first compartment in which the pillow is received and a second, relatively smaller, oppositely facing compartment including closure means at the outside edge thereof; said cover further comprising third and fourth compartments formed along the long edges of the cover, a first pair of reinforcing members received in said third compartment and a second pair of reinforcing members received in said fourth compartment, said cover further comprising fastener means located at the corners thereof for enabling the opposite edges of the cover to be secured together to form a carrying case, said cover further comprising at least two grommeted openings therein which are arranged to be aligned with the grommeted openings in the beach towel; and a plurality of stakes adapted to be inserted through the openings in said cover and openings in said beach towel in alignment therewith, and through the openings at the opposite edge of the beach towel, for affixing the beach towel, and the cover, with the pillow in an inflated condition received therein, to the sand, while connecting the cover and beach towel together.

* * * * *